US006645635B2

(12) United States Patent
Muraki

(10) Patent No.: US 6,645,635 B2
(45) Date of Patent: Nov. 11, 2003

(54) LAMINATED RUBBER STOPPER FOR A MEDICAMENT VIAL

(75) Inventor: Tomoyasu Muraki, Tokyo (JP)

(73) Assignee: Daikyo Seiko, Ltd., Tokyo (JP)

( * ) Notice: Subject to any disclaimer, the term of this patent is extended or adjusted under 35 U.S.C. 154(b) by 0 days.

(21) Appl. No.: 10/046,723

(22) Filed: Jan. 17, 2002

(65) Prior Publication Data

US 2002/0142124 A1 Oct. 3, 2002

(30) Foreign Application Priority Data

Jan. 19, 2001 (JP) ..... 2001-011632

(51) Int. Cl.[7] ..... B32B 25/04
(52) U.S. Cl. ..... 428/422; 428/68; 215/364
(58) Field of Search ..... 428/68, 422; 220/801; 215/247, 364

(56) References Cited

U.S. PATENT DOCUMENTS 3,628,681 A * 12/1971 Schwartz ..... 215/364
4,441,621 A * 4/1984 Matukura et al. ..... 215/247

FOREIGN PATENT DOCUMENTS

EP 0 294 127 12/1988

OTHER PUBLICATIONS

"FluoropolymersTypes and Features", Daikin, Online 2000, XP002197485 retrieved from the Internet: <URL: http://www.daikin.co.jp/chm/en/pro/fluoro/jusi.html>, retrieved on Apr. 25, 2002, Dec./2000.

* cited by examiner

*Primary Examiner*—Alexander S. Thomas
(74) *Attorney, Agent, or Firm*—Wenderoth, Lind & Ponack, L.L.P.

(57) ABSTRACT

The present invention aims at providing an improved thermoplastic film-laminated rubber stopper for a medicament vial, having more sufficient and excellent sealing property as well as barrier effect of permeation, in which the whole lower surface or the whole lower surface and a part of the upper surface of the rubber body is laminated with a thermoplastic film, in particular, tetrafluoroethylene resin film, having a flexural modulus in a range of at most 600 MPa and a coefficient of kinetic friction in a range of at most 0.4.

7 Claims, 1 Drawing Sheet

LAMINATED RUBBER STOPPER FOR A MEDICAMENT VIAL

BACKGROUND OF THE INVENTION

1. Field of the Invention

This invention relates to a laminated rubber stopper, in particular, a laminated rubber stopper used for sealing vials, specifically, vessels for medicaments, medical vessels, instruments, etc. (which will hereinafter be referred to as "a laminated rubber stopper for a medicament vial").

2. Description of the Prior Art

For a stopper material of a medicament vessel, medical vessel, instrument, etc., it is required to have heat resistance, compression strain resistance, enriched softness, chemical inertness and low permeability to gases or water. In respect of the sealing property, in particular, rubbers are excellent and there have been used natural rubbers from olden times and synthetic rubbers of late, for example, isobutylenes, isoprene copolymer rubbers (IIR), etc. having been recommended from the sanitary point of view. When using these rubbers, however, there arise problems that vulcanizers, compounding agents, etc. contained in the rubbers dissolve in medicaments held in vessels, vessel contents adsorb on rubber surfaces and contamination takes place due to fine particles from the rubber materials during production steps or storage of medicaments.

As described above, the rubber stopper used with a vessel for an injection to give an important function for maintaining stability of the injection is generally in a coated form with a thermoplastic olefinic resin such as polypropylene or polyethylene or a fluoro resin, in such a manner that a part or whole part of the surface area to be contacted with the injection is laminated, so as to prevent the rubber stopper from dissolving or evaporating of compounding chemicals or vulcanizing reaction products in the injection.

For example, JP-A-60-251041 discloses a laminated rubber stopper using a fluoro resin with a specified composition, JP-A-63-296756 discloses both surfaces-laminated rubber stopper for medicaments, in which a part or whole part of the lower surface and the upper surface are laminated with a fluoro resin, JP-A-2-136139 discloses a rubber stopper for a medical container, in which a soft fluoro resin with a specified composition is laminated and JP-A-59-005046 discloses a laminated rubber stopper for a medicament, in which the whole of the lower surface is laminated with a specified fluoro resin, and a process for the production of the same.

In addition, U.S. Pat. No. 4,554,125 discloses a laminated rubber stopper for a medicament, in which the whole lower surface is laminated with soft polypropylene resin, JP-A-3-140231 and U.S. Pat. No. 5,527,580 disclose a laminated rubber stopper for a vial, in which a part or whole part of the lower surface is laminated with polyethylene resin having a limited molecular weight, and further, a process for the production of the same is disclosed in JP-A-3-270928. Rubber stoppers for medicaments, having various forms, obtained by the prior art, have different quality and function, depending on the quality of the laminated film and the laminated site, in combination.

In particular, an invention described in the above described JP-A-59-005046 relates to a rubber stopper comprising a synthetic rubber whose lower surface is fully laminated with a film of a fluorine-containing copolymer and a process for the production of the same, the copolymer being selected from FEP, PEA, ETFE, etc.

However, the quality and function required for a rubber stopper for an injection include sealing property, medicament adaptability (role for mainly maintaining stability of a content medicament for a long time), self-closing property, resistance to fragmentation (also referred to as fragment resistance), sterilization adaptability and many other physicochemical properties. In an injection of a lately developed, new type, above all, a number of improving efforts of the physicochemical properties of a rubber stopper as to protecting the medicament from contamination due to rubber compounding components have been made for the purpose of the medicament stability related with antioxidation property, sealing property for protecting from bacteria contamination and deterioration or potency lowering of micro amount components, but in fact, sufficient results have not been obtained yet.

Under the situation, in the practice of the prior art, for example, a rubber stopper having a fluoro resin film laminated on the lower surface of the rubber stopper, there are obtained excellent effects in medicament stability, but such a problem has arised that the sealing degree is largely dispersed by influences of the dimensional precision (roughness of upper surface of vial mouth part or inner diameter thereof).

The inventors have made various efforts to solve the above described problems and consequently have found that the fluoro resin has more excellent barrier effect of permeation (barrier property) than other thermoplastic resins and in addition, the sealing property of a rubber stopper can be obtained by selecting a fluoro resin having a small flexural modulus, to be laminated, and lower friction resistance with the upper surface of the vial mouth part. The present invention is based on this finding.

SUMMARY OF THE INVENTION

It is an object of the present invention to provide a laminated rubber stopper for a medicament vial, whereby the above described problems can be resolved.

It is another object of the present invention to provide a laminated rubber stopper for a medicament vial, in which a surface of the rubber body is laminated with a PTFE film, whereby more sufficient and excellent sealing property and barrier effect of permeation as compared with thermoplastic resin film of the prior art can be given.

These objects can be attained by a laminated rubber stopper for a medicament vial, in which the whole lower surface or the whole lower surface and a part of the upper surface of the rubber body is laminated with a thermoplastic film having a flexural modulus in a range of at most 600 MPa and a coefficient of kinetic friction in a range of at most 0.4.

BRIEF DESCRIPTION OF THE DRAWINGS

The accompanying drawing is to illustrate the principle and merits of the present invention in detail.

DETAILED DESCRIPTION OF THE INVENTION

Figure 1:
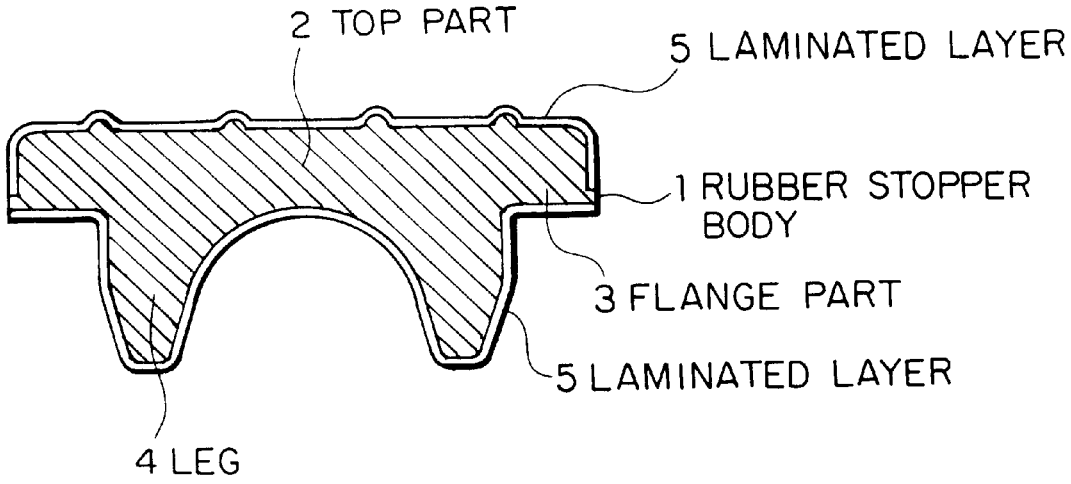
FIG. 1 is a cross-sectional view of a embodiment of a laminated rubber stopper for a medicament vial.

As a means for solving the above described problems, there are provided the following inventions and embodiments:

(1) A laminated rubber stopper for a medicament vial, in which the whole lower surface or the whole lower surface and a part of the upper surface of the rubber body is laminated with a thermoplastic film having a flexural modulus in a range of at most 600 MPa, preferably at most 400 MPa and a coefficient of kinetic friction in a range of at most 0.4, preferably at most 0.2.

(2) The laminated rubber stopper for a medicament vial, as described in the above (1), wherein the thermoplastic film has a thickness of 1 to 300 Am.

(3) The laminated rubber stopper for a medicament vial, as described in the above (1) or (2), wherein the thermoplastic film is a tetrafluoroethylene resin film or a modified tetrafluoroethylene resin film.

(4) The laminated rubber stopper for a medicament vial, as described in any one of the above (1) to (3), wherein thermoplastic plastic film is prepared by a casting method or a skiving method.

(5) The laminated rubber stopper for a medicament vial, as described in the above (3), wherein the modified tetrafluoroethylene resin film consists of a fluoro resin having improved creep resistance and further improved flexural property, weldability, drawing and stretching property and in the form of grains having a mean grain diameter of several ten microns, which tend to be fused to give a dense worked film during sintering.

(6) The laminated rubber stopper for a medicament vial, as described in the above (1), wherein the tetrafluoroethylene resin film is prepared by a casting method or skiving method using, as a raw material, a suspension containing tetrafluoroethylene resin powder having a maximum grain diameter of 0.01 to 1.0 $\mu$m, dispersing agent and solvent.

As the thermoplastic film having a flexural modulus in a range of at most 600 MPa, preferably at most 400 MPa and a coefficient of kinetic friction in a range of at most 0.4, preferably at most 0.2, there are preferably used PTFE, THV (ternary copolymer of TFE/HFP/VDF), etc.

In the general formulation provisions of the Japanese Pharmacopoeia of 13th Revision, it is provided that a container for an injection agent must be a hermetic container and the hermetic container is defined as a container capable of preventing a medicament from contamination with gases or microorganisms during daily handling and ordinary storage. Considering the prior art in view of this official provision, the resin film-laminated sealing stopper has a large effect on inhibition of dissolving-out of a rubber component of the stopper body, but the sealing property tends to be lowered because of not using silicone oil.

In the above described sealing stopper the inventors have developed, it is necessary in order to maintain sufficient the sealing property to design so that a difference between the outer diameter of the sealing stopper and the inner diameter of the syringe is somewhat larger and consequently, there arises a problem that the sliding resistance during administering a medicament is somewhat increased.

On the other hand, the inventors have made various studies about resins to be laminated on surfaces of sealing stoppers and consequently, have reached a conclusion that PTFE is most suitable, as compared with other fluoro resins, for example, tetrafluoroethylene-perfluoroethylene copolymer (PFA), tetrafluoroethylene-hexafluoropropylene copolymer (FEP), tetrafluoroethylene-ethylene co-polymer (ETFE), trichlorotrifluoroethylene (PCTFE), polyvinylidene fluoride (PVDF), polyvinyl fluoride (PVF), etc.

The above described other fluoro resins can be subjected to thermal melt molding, for example, injection molding or extrusion molding, but tetrafluoroethylene resin (which will hereinafter be referred to as PTFE sometimes) having a melt flow rate (MFR) of substantially zero at its melting point of 327° C. and being non-sticky cannot be subjected to thermal melt molding [Cf. "Plastic No Jiten (Plastic Dictionary)", page 836–838, published by Asakura Shoten, Mar. 1, 1992]. Accordingly, a film of PTFE is obtained by compression molding to give a sheet, by shaping in a block and cutting or slicing the block to give a relatively thick sheet or by skiving working to give a thinner film.

The skiving method will further be illustrated in detail. A suitable amount of a powdered resin raw material for shaping working, obtained by suspension polymerization to give a grain diameter of ~10 $\mu$m, is charged in a metallic mold for sintering shaping, previously shaped at room temperature and at a pressure of 100 to 1000 kg/cm$^2$ in a compression press and then sintered at 360 to 380° C. for several hours ordinarily but depending on the size of a shaped product. Then, the metallic mold is cooled at normal pressure or at some pressure, thus obtaining a primary shaped product in the form of a sheet, block or cylinder. The shaped product of PTFE in the form of a cylinder, obtained in the above described compression shaping, is fitted to a lathe and revolved, during which an edged tool is pressed against the shaped product at a constant pressure and a specified angle to obtain a PTFE film with a thickness of at least 40 to 50 $\mu$m and at most 200 $\mu$m.

The film prepared by this skiving method has a disadvantage that there remain pinholes or skiving scratches on the surface thereof and accordingly, the film is not suitable for laminating a sealing stopper for preventing it from leaching of rubber components in a medicament and contaminating the medicament.

On the other hand, a casting method comprising adding a latex emulsion to a suspension of fine grains of a fluoro resin, thinnly spreading the mixture on a metallic surface and then burning to obtain a film has been known as disclosed in U.S. Pat. No. 5,194,335. According to this method, a film with a thickness of up to about 3 $\mu$m can be produced.

The present invention, as described above, provides a laminated rubber stopper for a medicament vial, in which the lower whole surface or the lower whole surface and upper partial surface of the rubber body is laminated with a thermoplastic film having a flexural modulus in a range of at most 600 MPa and a coefficient of kinetic friction in a range of at most 0.4.

FIG. 1 is a cross-sectional view of one embodiment of a laminated rubber stopper according to the present invention, in which a main body 1 of the rubber stopper consists of IIR, the lower surface of a flange part 3 and leg part 4 and the upper surface of an upper part 2 is laminated with a PTFE film 5.

As a result of our studies, it is found that when the thermoplastic film 5 laminated on the surface of the main body 1 of the rubber stopper, in particular, the whole lower surface satisfies specified properties (which will hereinafter be referred to as "specified properties"), i.e. a flexural modulus of at most 600 MPa, preferably at most 400 MPa, meausured according to JIS K 7203-1982, CASTM D 790; Conversion Formula 1 MPa=10.197145 kg/cm$^2$ and a coefficient of kinetic friction of at most 0.4, preferably 0.2 measured according to JIS K 7218-1986, very high sealing property and sliding property can be realized, and that from the standpoint of a resin film having the sanitary property and chemical stability required in the field of using the laminated rubber stopper for medicament according to the present invention, in particular, PTFE films are most suitable, and, above all, PTFE film prepared by the casting method using specified raw materials is most suitable for obtaining the flexural modulus specified in the scope of the present invention. Thus, present invention is based on this finding. Accordingly, higher sealing property as well as higher sliding property (lower kinetic friction resistance) are obtained to improve the quality maintenance of medicaments and further make easier a medical treatment.

The reason why PTFE is particularly selected and used from various fluoro resins in the present invention is that PTFE has such a stable property that dissolving or swelling does not appear in substantially all medicaments, PTFE has such an excellent heat resistance of organic materials that at about 327° C. corresponding to the melting point, it becomes only transparent gel-like and does not show melt flow property, and the continuous application tempearure is very high, i.e. about 260° C., a PTFE film has a surface excellent in hydrophobic property, lipophobic property and non-sticky property and PTFE has an excellent slidable property such as represented by a smaller coefficient of kinetic friction as shown in Table 1 than that of other plastics. According to these advantages, physical properties and chemical properties required for a surface laminating film of a sealing stopper for a syringe can be satisfied because of being resistant to a sterilizing processing at a high temperature in a formulation process, being free from adsorption or elusion even if contacted with a medicament filled inside for a long time and chemically stable and having such a high slidable property that a sealing stopper can smoothly be thrusted in a syringe during administration of a medicament.

TABLE 1

| Resin | Coefficient of Kinetic Friction ($kg/cm^2 \cdot m/sec$) |
|---|---|
| Polytetrafluoroethylene (PTFE) | 0.2 |
| Nylon 66 | 0.4 |
| Polyoxymethylene | 0.4 |

As the PTFE of the present invention, any one capable of satisfying the specified flexural modulus and coefficient of kinetic friction can be used independently of the production process, but since the PTFE film meets with the problem of pinholes when it is subjected to slicing or skiving as described above, it is particularly preferable to employ a casting method capable of providing excellent surface properties so as to realize the above described specified property values.

As the thickness of a film to be laminated on a rubber stopper body is the thinner, the rubber elasticity can more effectively be utilized and the sealing property is the better, but handling of the film is difficult during producing and lamination working of the laminated stopper. Thus, the thickness of the PTFE film according to the present invention is generally about 0.001 mm to 0.3 mm (1 to 300 $\mu$m), preferably 0.001 to 0.05 mm, more preferably 0.005 to 0.03 mm. In the practical production, the void volume of the thin film is low in the case of a thickness range of 0.01 to 0.05 mm, the proportion of a defective product being decreased. Production of the rubber stopper with a laminated film thickness of at most 0.001 mm is difficult and this is a critical limit in the lamination working of a rubber stopper body. On the other hand, a thickness exceeding 0.3 mm is not preferable because of not obtaining high sealing property.

In the laminated rubber stopper for a medicament, the most suitable resin film thickness is considered as follows. In the scope of the prior art (technique of coating a thermoplastic resin film having a flexural modulus exceeding 600 MPa), a sufficient degree of sealing between the rubber stopper and container cannot be obtained in the case of coating the whole lower surface of the rubber stopper. In particular, as the thickness of the resin film gets thicker, there occurs such a tendency that a large difference in rigidity appears between the rubber part and coated part and the sealing property is further lowered. Accordingly, it is required that the thickness of the resin film is decreased within a range of allowed limit of the production technique (coating working). On the other hand, during use for the formulation, coating of a thinner resin film is also essential for protecting the rubber stopper from leakage of an injection liquid during drawing out a needle or from coring (fragmentation, occurrence of rubber pieces), as to quality designing of the rubber stopper.

In the present invention, however, the degree of freedom as to the thickness of the coating film (resin film) can be much more increased by the use of a coating material (resin film) with a smaller flexural modulus, that is, allowing the modulus to approach the modulus of the rubber, as compared with the prior art. This is the largest advantage of the present invention.

The surface roughness of the PTFE film is at most 0.20 $\mu$m, preferably at most 0.05 $\mu$m by Ra.

Production of the PTFE film having the above described specified properties by a casting method will specifically be illustrated. A PTFE suspension is prepared by the use of a suitable dispersing agent, the suspension having such a grain diameter that a stable suspended state can be maintained, i.e. a maximum grain diameter of 0.01 to 1.0 $\mu$m, preferably at most 0.5 $\mu$m, and a solid concentration of about 35 to 60%. A more preferred concentration is about 40 to 50%. As a solvent and dispersing agent, there can be used commonly used ones. As the dispersing agent, for example, there is used a non-ionic surfactant such as Nissan Nonion HS 208 (Commercial Name, manufactured by Nippon Yushi Co., Ltd.). As the solvent, for example, water can be used. In Table 2 are shown examples of compositions of the suspensions without limiting the present invention.

TABLE 2

| | Weight (g)/Volume (1) | Resin Concentration (weight %) | Density of Suspension |
|---|---|---|---|
| PTFE Resin | 900 | 60 | 1.50 |
| | 693 | 50 | 1.39 |
| | 601 | 45 | 1.34 |
| | 515 | 40 | 1.29 |
| | 436 | 35 | 1.24 |
| Surfactant[1)] | 1 weight % | | |
| Solvent[2)] | 1 liter (total) | | |

(note)
[1)]Nissan Nonion HS 208 (Commercial Name, manufactured by Nippon Yushi Co., Ltd.)
[2)]water The suspension is poured onto a high heat resistance, rust proofing belt, for example, stainless steel belt, heated in a heating furnace of closed type at a temperature of at least the melting point of PTFE (327° C.) to evaporate water content and then subjected to sintering working for 4 to 6 hours to form a thin film. Since the feature of this method consists in directly preparing a thin film without a step of preparing a cylindrical primary work as in other working methods, there can be obtained a thin film free from pinholes or surface scratches due to the above described skiving working method. Furthermore, a very fine PTFE with a maximum grain diameter of at most 1.0 μm is herein used, thus resulting in a film product with a true specific gravity of approximately 2.14 to 2.20, which has scarcely pinholes even as a result of visual observation or pinhole investigation and exhibits very small surface roughness (roughness degree), i.e. excellent smoothness.

A rubber used for the sealing rubber stopper of the present invention is not particularly limited, but is exemplified by synthetic rubbers such as isoprene rubbers, butadiene rubbers, styrene butadiene rubbers, ethylene propyrene rubbers, isoprene-isobutylene rubbers, nitrile rubbers, etc. and natural rubbers. The rubber used as a predominant component can be blended with additives such as fillers, cross-linking agents, etc.

Lamination of a surface of a rubber stopper with a PTFE film according to the present invention can be carried out by a known technique, for example, comprising subjecting one side of a film to a chemical etching treatment, sputter etching treatment or corona discharge treatment, arranging the film in a metallic mold for shaping with a rubber compound as a base material of a sealing stopper body and then vulcanizing, bonding and shaping in a predetermined shape.

The present invention will now be illustrated in detail by the following Examples and Comparative Examples without limiting the same.

REFERENCE EXAMPLE 1

Production of PTFE Film (PTFE-1) by Casting Method 6.01 kg of PTFE fine powder (maximum grain diameter: less than 1 m, mean grain diameter: 0.1 μm) was added to 10 liter of Nissan Nonion HS 208 (non-ionic surfactant) diluted with distilled water to 6% and adequately suspended and dispersed by means of a homogenizer to obtain 16.01 kg of a 45 weight % PTFE suspension. The suspension was coated onto a cleaned and polished stainless steel plate to give a coating thickness of 10 g m (generally, 5–20 μm), dried for 1.5 minutes by an infrared lamp and heated at 360 to 380° C. for about 10 minutes to evaporate the surfactant. After repeating this procedure four times (generally, 1–8 times), the suspension was sintered in a thickness of about 40 μm (0.04 mm) (generally, 10–60 μm). After the last sintering, the resulting layer was quenched with water and stripped from the metal plate to obtain a clear PTFE casting film (PTFE-1 shown in Table 3). The number of the procedures was increased or decreased and thus, a film with a desired thickness could be obtained.

REFERENCE EXAMPLE 2

Production of PTFE Film (PTFE-2) by Skiving Method

For comparison, a PTFE film was produced by the skiving method of the prior art, as described in the column of Prior Art (PTFE-2). The same PTFE fine powder as that of Reference Example 1 was uniformly charged in a metallic mold having a diameter of 250 mm and height of 2000 mm and being of a polished stainless steel sheet, while passing through a stainless steel sieve of 10 mesh. The fine powder was gradually compressed to 300 kg/cm$^2$ at normal temperature and maintained for 25 minutes to obtain a preformed product, which was heated to 370° C. at a rate of 10° C./min in an electric furnace and maintained at this temperature until the whole material was uniformly sintered. The sintered product was then cooled to room temperature at a temperature lowering rate of 15° C./min to obtain a sintered article. The thus obtained sintered round rod (300 mm diameter×500 mm height) was subjected to skiving working, thus obtaining a PTFE film with a thickness of about 40 μm (Cf. Table 3).

The flexural modulus of the thus resulting PTFE-1 and PTFE-2 films and a PTFE film (THV-2) obtained by an extrusion method, as Reference Example 3, was measured by the following measurement method.

That is, measurement of the flexural modulus is carried out according to JIS K 7203-1982, "Method for the bending test of a hard plastic".

The surface roughness of each of the above described PTFE films was measured using a surface roughness and shape measurement device (Surfcom® 550A—commercial name—, manufactured by Tokyo Poldwin Co., ltd.) at a magnification of 6000, a cutoff value of 0.5 mm and a measured length of 4.0 mm, thus obtaining results as shown in Table 3. This mesurement was carried out as to only the film, not after laminated, since the measurement of the laminated film was impossible from the structure of the measurement device.

Measurement Method of Coarse Surface Roughness on Film Surface

Measurement of the surface roughness was carried out according to JIS B0601-1982 using the surface roughness and shape measurement device of needle touch type (Surfcom® 550A, manufactured by Tokyo Poldwin Co., ltd.). While the needle part of the measurement device was applied to a surface of a sample and moved within a predetermined range, an average roughness (Ra) on the center line, maximum height (Rmax) and ten point average roughness (Rz) were measured to obtain a measured chart, from which Ra, Rmax and Rz were read. The measurement was carried out six times as to each sample and arithmetical average values of Ra, Rmax and Rz were obtained excluding the maximum value. Ra and Rz values represented the roughness depths of the film surface by numeral as an arithmetical average of all the roughness depth profiles from the center line.

As to each of the foregoing Samples PTFE films, a film of 40 μm thick was prepared and subjected to measurement of the kinematic friction factor of the surface according to the following measurement method. Measured results and properties of the each film are shown in Table 3.

Measurement Method of Coefficient of Kinetic Friction

The coefficient of kinetic friction is a coefficient representative of a degree of sliding (slidability) of a film. According to JIS K7218-1986, the coefficient of kinetic friction of a surface of a sample was measured using a friction and abrasion tester of Matsubara type (manufactured by Toyo Poldwin Co., Ltd.) under test conditions of workpiece: SUS, load: 5 kgf to 50 kgf (same load for 30 minutes every 5 kgf), speed: 12 m/min, time: 168 hours. Calculation of the coefficient of kinetic friction was carried out by the following formula:

Coefficient of Kinetic Friction ($kg/cm^2 \cdot m/sec$)=kinetic friction force at vertical load of 15 *kgf*/load 15 *kgf*

TABLE 3

| Examples | Reference Example 1 | Reference Example 2 | Reference Example 3 |
|---|---|---|---|
| Film No. | PTFE-1 | PTFE-2 | THV-2 |
| Variety of Resin | PTFE : | PTFE : | TFE/HFE/ |
| Production Process | Casting Method | Skiving Method | VDF : Extrusion Method |
| Flexural Modulus (MPa) | 435 | 402 | 73 |
| An Average Roughness on the Center Line : Ra (μm) | 0.136 | 0.036 | 0.020 |
| Maximum Height : Rmax (μm) | 0.212 | 0.910 | 0.205 |
| Ten Point Average Roughness : Rz (μm) | 1.290 | 0.396 | 0.211 |

TABLE 3-continued

| Examples | Reference Example 1 | Reference Example 2 | Reference Example 3 |
|---|---|---|---|
| Coefficient of Kinetic Friction (kg/cm$^2$ · m/sec) | 0.07 | 0.10 | 0.10 |
| Thickness ($\mu$m) | 50 | 50 | 50 |

REFERENCE EXAMPLE 4

Example of Rubber Compounding

An example of a rubber recipe is shown in the following Table 4.

TABLE 4

| Composition | Compounding Example 1 | 2 | 3 |
|---|---|---|---|
| Butyl Rubber[1)] | 100 | | |
| Chlorinated Butyl Rubber[2)] | | 100 | |
| Partially Cross-linked Butyl Rubber of Ternary Polymer of Isobutylene · Isoprene · Divinylbenzene[3)] | | | 100 |
| Wet Process Hydrated Silica[4)] | 35 | 30 | 30 |
| Dipentanemethylene Thiuram Tetrasulfide[5)] | 2.5 | | |
| Zinc Di-n-dibutylthiocarbamate[6)] | 1.5 | | |
| Active Zinc Oxide[7)] | 5 | 4 | 1.5 |
| Stearic Acid[8)] | 1.5 | 3 | |
| Magnesium Oxide[9)] | | 1.5 | |
| 2-Di-n-Butylamino-4,6-dimercapto-s-triazine[10] | | 1.5 | |
| 1-1-Bis(t-butylperoxy)-3,3,5-trimethylcyclohexane[11)] | | | 2 |
| Total (by weight) | 145.5 | 140.0 | 133.5 |
| Vulcanizing Conditions | | | |
| Temperature (° C.) | 175 | 180 | 150 |
| Time (min) | 10 | 10 | 10 |

(Note)
[1)]manufactured by Exxon Chemical Co., Ltd., Esso Butyl # 365 (commercial name), bonded isoprene content: 1.5 mol %, Mooney Viscosity: 43 to 51
[2)]manufactured by Exxon Chemical Co., Ltd., Esso Butyl HT 1066 (commercial name), bonded chlorine content: 1.3 wt %, Mooney Viscosity: 34 to 40
[3)]manufactured by Bayer AG, Bayer Butyl XL-10000 (commercial name)
[4)]manufactured by Nippon Silica Kogyo Co., Ltd., Nipsil ® ER (commercial name), pH: 7.5 to 9.0 (5% aqueous solution)
[5)]manufactured by Kawaguchi Kagaku Kogyo Co., Ltd., Accel ® TRA (commercial name), mp: at least 120° C.
[6)]manufactured by Kawaguchi Kagaku Kogyo Co., Ltd., Accel ® BZ (commercial name)
[7)]manufactured by Seido Kagaku Kogyo Co., Ltd., Active Zinc White AZO (commercial name), ZnO 93 to 96%
[8)]manufactured by Kao Co., Ltd., Lunac ® S# 30, (commercial name, composition: plant stearic acid)
[9)]manufactured by Kyowa Kagaku Kogyo Co., Ltd.. Kyowa Mag # 150 (commercial name), specific surface area: 130 to 170 mg
[10)]manufactured by Sankyo Kasei Co., Ltd., Zisnet ® DB (commercial name), mp: at least 137° C.
[11)]manufactured by Nippon Yushi Co., Ltd., Perhexa ® 3M-40 (commercial name), molecular weight: 302, one minute half-life temperature: 149° C.

EXAMPLE 1

In this Example 1, a rubber sheet having an excellent gas permeability-resistance of Compounding Example 2 in Table 4 was used. According to the compounding formulation, the mixture was kneaded using an open roll, aged for 24 hours and heated to obtain an unvulcanized rubber sheet. The resulting rubber sheet and the PTFE-1 film with a thickness of 40 $\mu$m, obtained in the foregoing Reference Example 1, were placed on a metallic mold for shaping, corresponding to a cross-sectional shape of a stopper shown in FIG. 1, pressed at a mold-fastening pressure of 150 kg/cm$^2$ depending on the vulcanization conditions of at 150 to 180° C., vulcanized for 10 minutes, and the whole body of the rubber stopper was laminated with PTFE-1 film to prepare a laminated rubber stopper with a cross-sectional shape as shown in FIG. 1.

The physical values of the PTFE-1 used herein and estimation results of the sealing property of the laminated rubber stopper, obtained by the use of this film, are shown in the following Table 5.

The following test methods were used to estimate the sealing property.

i) Airtight Test

In an air tight test, the initial value of an inner pressure in a sample vial and the leak value (leakage) during passage of time are measured.

ii) Moisture Permeability test

A moisture permeability test aims at measuring an amount of steam permeated through a fitting part of a rubber stopper to a vial, assuming a case where a highly hygroscopic reagent is sealed.

iii) Microorganism Challenge Test

A microorganism challenge test aims at estimating presence or absence of invasion of microorganisms propagated through cell division.

(1) Preparation of Sample Vial

Sample rubber stoppers were respectively mounted on twenty clean vials made of borosilicate glass with a determined volume of 10 mL and placed in a pressure reduced chamber. The chamber was evacuated to an about limited value (about 4 torr) by a vacuum pump, a plunger provided at an upper part of the reduced chamber was pressed down and the lower part (leg part) of the rubber stopper is inserted into the mouth part of each of the vials.

(2) Confirmation Test of Sealing Property i) Airtight Test

Every thirty six samples of sample vials (commercially available borosilicate glass) and sample rubber stoppers were taken and each of the sample rubber stoppers was inserted into the vial mouth in such a loosened manner that the interior of the vial and a freeze-drying chamber (hereinafter referred to as "chamber") were not airtight. As the freeze-drying chamber, there was used a freeze-drying chamber Model FDU-830 (Freeze-Drying Chamber BSC-2L, Tokyo Rika Kikai Co., Ltd.—commercial name—), in which these samples were charged and subjected to reducing at a pressure guage of about 4 torr (400 Pa). The thus stoppered sample vials were taken out of the chamber and covered by commercially available aluminum caps, followed by fastening using a hand climper (manual fastening tool of aluminum cap) and sealing.

After preparing the sample vial, a needle for a disposal syringe of 21 G was adapted to Digital Manometer (manufactured by Toyota Koki Co., Ltd.) provided with a metallic hub for an injection needle at the end of a tube, pierced in the sample vial to measure the pressure in the vial and an initial value $P_0$ was recorded. After 3 hours, the inner pressure of the residual ten sample vials was measured to record the pressure as $P_3$.

$P_0$–$P_3$ (torr) is defined as "leaked amount" (amount of leakage) and described as a result of the airtight test in Table 5.

2) Moisture Permeability Test

Twelve vials made of borosilicate glass (hereinafter referred to as sample vial) with a volume of 10 mL was taken, subjected to cleaning of the surface with a dried cloth and each sample was uniformly opened and closed evry time for 30 times. Ten samples of them were used as a sample vial and the residual samples were used as a comparative vial. To each of these sample vials was added calcium chloride for measuring a water content, having previously been passed through a sieve of 4 mesh, dried at 110° C. for 1 hour and allowed to cool in a desiccator, and from level of the stopper of the sample vial to ⅔ volume of the vial was filled. After adding a drier, the vial was immediately plugged by the sample rubber stopper (hereinafter referred to as "full plugging"), fastened by an aluminum cap using a manual fastening tool and tightly sealed.

Two comparative sample vials were taken, filled with glass beads to be substantially the same weight as the sample vial and similarly tightly sealed.

The weight of each of the thus prepared sample vials was precisely weighed upto a unit of 0.1 mg and stored at a relative humidity of 75±3% and a temperature of 20±2° C. After allowing to stand for 14 days, similarly, each of the sample vial was subjected to precise weighing. Separately, five vacant sample vials were taken and fully filled with water or a non-compressive, non-fluidity solid such as fine glass beads upto a level corresponding to the surface when correctly plugging. The content of the each sample was removed to a graduated cylinder to measure a mean content (mL). The water content permeation speed (mg/day/L) was calculated by the following formula:

$$\text{Water Content Permeation Speed } (mg/day/L) = (1000/14V)\{T_f - T_i\} - \{C_f - C_i\}$$

V: mean content (mL)

$T_f - T_i$: difference in weight between times of starting and finishing of sample vial in each test (mg)

$C_f - C_i$: average of difference in weight between times of starting and finishing of two control samples (according to Japanese Pharmacopoeia of 13th Revision, General Test Method 5. Steam Permeation Property Test)

3) Microorganism Challenge Test

Test Procedure of Bacteria Suspension Permeation

Five hundred sample vials each having a volume of 10 mL were respectively charged with 10 mL of SCD culture mdeium, fully plugged with a sample rubber stopper, fastened by an aluminum cap and tightly sealed.

The SCD culture mdeium in the sample was sterilized by heating at 121° C. for 15 minutes in an autoclave. Each of these samples was immersed in an SLB culture medium in which Brevundimonas diminuta (ATCC No. 19146) had been suspended with a concentration of at least about $10^7$ cfu/mL, stored for 168 hours under a constant pressure of 16.2 GPa over whole test atmosphere and it was then confirmed that no bacteria entered the SCD culture medium in the sample medium.

In the column of "Microorganism Challenge Test" of Table 5, the result of culture mdeium efficiency test is represented by "positive" in a case where at least one of the five hundred sample vials is contaminated with the microganisms, organsims while it is represented by "negative" where there is no contamination with the microorganisms.

EXAMPLES 2 TO 4

Using PTFE-2 and modified PTFE (THV-2), obtained in Reference Examples 2 and 3, and ETFE-2, laminated rubber stoppers were obtained and subjected to estimation of the properties and sealing property of the films, in an analogous manner to Example 1, thus obtaining results as shown in Table 5.

COMPARATIVE EXAMPLES 1 TO 7

Example 1 was repeated except using various films shown in Table 5, whose flexural moduli and coefficients of kinetic friction were outside the scope of the present invention, thus obtaining results shown in Table 5.

TABLE 5

| | Example | | | | Comparative Examples | | | | | | |
|---|---|---|---|---|---|---|---|---|---|---|---|
| Properties | 1 | 2 | 3 | 4 | 1 | 2 | 3 | 4 | 5 | 6 | 7 |
| Composition Note No. | PTFE-1 (1) | PTFE-2 (2) | Modified PTFE-3 (4) | ETFE-2 (5) | ETFE-1 (3) | THV-1 (6) | THV-2 (7) | PVDF (8) | PE-1 (9) | PP-1 (10) | PP-2 (11) |
| Melting Point (° C.) | 328 | 327 | 324 | 214 | 270 | 166 | 122 | 160 | 135 | 138 | 158 |
| Flexural Modulus (MPa) | 435 | 402 | 424 | 588 | 705 | 176 | 73 | 1,034 | 610 | 873 | 1,570 |
| Coefficient of Kinetic Friction | 0.07 | 0.10 | 0.10 | 0.38 | 0.35 | 0.46 | 1.08 | 0.15 | 0.42 | 2.5 | 1.5 |
| Film Thickness (μm) | 50 | 50 | 50 | 50 | 50 | 50 | 50 | 50 | 50 | 50 | 50 |
| Airtight Test (torr) | +2 | +4 | +5 | +5 | +85 | +62 | +59 | +189 | +540 | +790 | +763 |
| Moisture Permeability Test after 8 Weeks (mg) | 0.3 | 0.2 | 0.3 | 0.1 | 125 | 79 | 55 | 380 | 691 | 427 | 542 |

TABLE 5-continued

| | Example | | | | Comparative Examples | | | | | | |
|---|---|---|---|---|---|---|---|---|---|---|---|
| Properties | 1 | 2 | 3 | 4 | 1 | 2 | 3 | 4 | 5 | 6 | 7 |
| Microorganisms Challenge Test | negative | negative | negative | negative | positive | negative | negative | positive | positive | positive | positive |

(Note of Table 5)
(1) PTFE-1 Nitoflon ® 901, commercial name, manufactured by Nitto Denko Co., Ltd., worked film material by casting method.
(2) PTFE-2 Nitoflon ® 901, commercial name, manufactured by Nitto Denko Co., Ltd., worked film material by skiving method.
(3) ETFE-l Neoflon ® EP-520, commercial name, manufactured by Daikin Kogyo Co., Ltd., worked film material by melt extrusion method.
(4) PTFE-3 modified PTFE resin, Newpolyflon ® PTFE M-111, commercial name, manufactured by Daikin Kogyo Co., Ltd., worked film material by skiving method.
(5) ETFE-2 Japanese Patent No. 1787483, Neoflon ®, commercial name, manufactured by Daikin Kogyo Co., Ltd., worked film material by melt extrusion method.
(6) Ternary Polymer of TFE/HFP/VDF, THV ® 500, commercial name, manufactured by Sumitomo Three M Co., Ltd., worked film material by melt extrusion method.
(7) Ternary Polymer of TFE/HFP/VDF, THV ® 220, commercial name, manufactured by Sumitomo Three M Co., Ltd., worked film material by melt extrusion method.
(8) PVDF Kynar ® 460, commercial name, manufactured by Mitsubishi Kagaku Co., Ltd., worked film material by melt extrusion method [Coefficient of Friction to steel: 0.15; Flexural Modulus (TMA: Thermal Mechanical Analysis): 150,000–170,000 psi]
(9) PE-1 Hizex Million ® 220, commercial name, manufactured by Daikin Kogyo Co., Ltd., worked film material by skiving method.
(10) PP-1 Sumitomo Noblen ® FL831, commercial name, manufactured by Sumitomo Kagaku Co., Ltd., worked film material by melt extrusion method, for CPP film, odorless, transparent [PZar] 1263-L, static friction coefficient (tan ⊖): 0.5
(11) PP-2 Sumitomo Noblen ® 0132L, commercial name, manufactured by Sumitomo Kagaku Co., Ltd., worked film material by melt extrusion method, for CPP film, odorless, transparent [PZar] 0132-L, static friction coefficient (tan ⊖): 0.3

Advantages of the Present Invention

According to the present invention, there is provided a rubber stopper for a vial, in which the whole lower surface or the whole lower surface and a part of the upper surface is laminated with a thermoplastic film such as PTFE, etc. to prevent the rubber from elution of medicaments and the flexural modulus and coefficient of kinetic friction of the film are specified, whereby an excellent sealing property and slidable property can be exhibited through the synergistic effect thereof.

What is claimed is:

1. A laminated rubber stopper for a medicament vial, in which the whole lower surface or the whole lower surface and a part of the upper surface of the rubber body is laminated with a thermoplastic film having a flexural modulus of at most 600 MPa, and a coefficient of kinetic friction of at most 0.4, wherein the thermoplastic film is a tetrafluoroethylene resin film or a modified tetrafluoroethylene resin film.

2. The laminated rubber stopper for a medicament vial, as claimed in claim 1, wherein the thermoplastic film has a thickness of 1 to 300 $\mu$m.

3. The laminated rubber stopper for a medicament vial, as claimed in claim 2, wherein the thermoplastic film is prepared by a casting method or skiving method.

4. The laminated rubber stopper for a medicament vial, as claimed in claim 1, wherein the thermoplastic film is prepared by a casting method or skiving method.

5. The laminated rubber stopper for a medicament vial, as claimed in claim 1, wherein the modified tetrafluoroethylene resin film consists of a fluoro resin having improved creep resistance and further improved flexural property, weldability, drawing and stretching property, which is obtained by sintering fine grains having a mean grain diameter of several ten microns, to give a dense worked film.

6. The laminated rubber stopper for a medicament vial, as claimed in claim 1, wherein the tetrafluoroethylene resin film is prepared by a casting method or skiving method using, as a raw material, a suspension containing tetrafluoroethylene resin powder having a maximum grain diameter of 0.01 to 1.0 $\mu$m, dispersing agent and solvent.

7. A laminated rubber stopper for a medicament vial, in which the whole lower surface or the whole lower surface and a part of the upper surface of the rubber body is laminated with a thermoplastic film having a flexural modulus of at most 600 MPa, a coefficient of kinetic friction of at most 0.4, and a thickness of 0.001 mm to 0.3 mm, wherein the thermoplastic film is a tetrafluoroethylene resin film or a modified tetrafluoroethylene resin film.

* * * * *